US008454019B1

(12) United States Patent
Stuempfl

(10) Patent No.: US 8,454,019 B1
(45) Date of Patent: Jun. 4, 2013

(54) AMERICAN CONSPIRACY BOARD GAME

(76) Inventor: Frank Stuempfl, Petaluma, CA (US)

( * ) Notice: Subject to any disclaimer, the term of this patent is extended or adjusted under 35 U.S.C. 154(b) by 0 days.

(21) Appl. No.: 12/609,610

(22) Filed: Oct. 30, 2009

(51) Int. Cl.
*A63F 3/00* (2006.01)

(52) U.S. Cl.
USPC ..... 273/243; 273/254

(58) Field of Classification Search
USPC ..... 273/243, 251, 252, 254
See application file for complete search history.

(56) References Cited

U.S. PATENT DOCUMENTS

| | | | | | |
|---|---|---|---|---|---|
| 3,865,380 | A * | 2/1975 | Thomas | 273/256 |
| 4,012,045 | A * | 3/1977 | Vail | 273/257 |
| 4,640,513 | A * | 2/1987 | Montijo | 273/249 |
| 5,435,726 | A * | 7/1995 | Taylor | 434/128 |
| 6,296,568 | B1 * | 10/2001 | Tracy | 463/17 |
| 6,598,878 | B1 * | 7/2003 | Burrowes | 273/243 |
| 2003/0094757 | A1 * | 5/2003 | Bedford | 273/241 |
| 2008/0272543 | A1 * | 11/2008 | Martineau | 273/243 |

* cited by examiner

*Primary Examiner* — Vishu K. Mendiratta
(74) *Attorney, Agent, or Firm* — Michael I. Kroll

(57) ABSTRACT

An educational board game that is comprised of authentic American government and newspaper article conspiracies involving the American people and culture. Play money, drug and oil stocks and gold, silver and platinum gold coin tokens are distributed and traded to acquire conspiracy files.

3 Claims, 10 Drawing Sheets

AMERICAN CONSPIRACY BOARD GAME

BACKGROUND OF THE INVENTION

1. Field of the Invention

The present invention relates generally to board games and, more specifically, to an educational board game which allows players to gain knowledge in the subject of American conspiracies. The board game is comprised of authentic previously classified U.S. government documents that have been released through the Freedom of Information Act (FOIA), and newspaper article conspiracies involving the American people and culture including Unidentified Flying Object (crashes, sightings, abductions) various U.S. military biological and chemical experiments conducted on U.S. civilians and members of the armed forces without their knowledge and other events that were once discussed and have know been forgotten. There are five separate series of conspiracy files; the first series comes free with the game, the other four series must be purchased separately.

RULES OF PLAY

Purpose:

To become the most educated on American conspiracies by collecting and acquiring individual conspiracy information files, platinum, money, gold, silver and stocks.

Supplies:

The included equipment is a triangular board, 2 regular dice, 1 money die, game player icons, gold coins (value $400.00), silver coins (value $50.00), platinum (value $1000.00) coins, drug stock, oil stock, $100.00, $10.00, $15.00 $5.00 dollar bills, and one conspiracy file for each of the 48 conspiracies and 52 mystery cards. Also included is a vault to store the gold, silver, platinum coins and play money.

Stability:

First make sure all players are mentally stable. The information in this game is real and might alter ones positive perspectives of the world in a pessimistic way. Children should only play the game in the company of compassionate adults.

Getting Started:

Place the triangle on a flat surface place the mystery cards on the board in the red brick triangle. Each player chooses an icon to identify him/her as they move clockwise around the board. Place one gold coin in the middle of the board. This gold coin will be awarded to anyone who lands on the Saucer Diamond.

Each player will get $3050.00 in assets from the vault at the start of the game. 1 platinum coin (value $1000.00), 2 gold coins (value $800.00), 4 shares of oil stock (value $400.00), 10 silver coins (value $500.00), 10 shares of drug stock (value $200.00), 5 fifteen dollar bills, 5 ten dollar bills, 5 five dollar bills. All remaining assets, stocks, gold, silver, money and platinum will be stored in the vault with the conspiracy files.

Money cannot be exchanged for stock directly from the bank. The only exception to this rule is if the mystery card the player draws permits it. Stock can be used at face value to pay any dept to other players or to the vault. Players can sell stock between each other for any price.

When players collect funds from the vault they can only receive one share of stock per transaction if they choose. Stocks can run out, if there are no stocks left in the vault then money must be substituted for any payments that come from the money die or mystery cards.

Saucer Diamond

A gold coin will be placed in the middle of the board prior to the start of the game.

Any fees/fines that players have to pay because of mystery cards will also go into the middle of the board. If any player lands on the saucer diamond they collect all the money that has accumulated in the middle of the board along with the gold coin. Another gold coin is place in the middle of the board after all the assets are collected.

Chief Financial Officer:

Select a CFO to keep track of all the assets in the vault and to manage the conspiracy files. The CFO or other players will not be allowed to read any of the conspiracy files while the game is in play.

All player icons will start on the red start diamond and move clockwise around the board. If a player rolls doubles the player continues to play. The player then has a choice to pass on their turn or roll again. If doubles are rolled for a third time the player must place $50.00 in the middle of the board and pass the dice to the next player.

After a player makes a full revolution around the board and passes the start point he/she rolls the money die once and receives the amount shown from the vault on the money die.

Purchasing Conspiracy Files:

All players must make one full revolution around the board before they can purchase conspiracy files unless they are playing a rapid game. The player must first land on the conspiracy file, and then he/she purchase that conspiracy from the CFO. The player then must read the entire file excluding the three questions aloud so everyone can learn about that file no note taking is permitted during the game.

Trading Conspiracy Files:

Conspiracy Files can be traded between players and sold for money. If a player lands on a file and cannot afford to pay the ransom this player loses and the other player who owns the file gets to pick one file from the losing players files. The rest of the files go back to the CFO and can only be purchased of a player lands on them.

Paying Ransom Money:

If you land on someone else's conspiracy file you are then held hostage and must pay a ransom to continue or try to answer a question about the file. If you answer the question correctly you will owe nothing and continue on your way. If you give the wrong answer you will now owe double of what was originally owed. The owner of the file can choose to let you look at the card to verify your answer is right or wrong so other players cannot learn the correct answer (s) for that file, there are three questions on each file. If all of one section of colors of conspiracy files is owned by one player the amount of ransom money owed will be compounded.

CIA:

If the CIA as a result of a mystery card is holding you captive you must place $100.00 worth of assets in the center of the board to be freed.

End of the Game:

The game will continue until the last player is eliminated or quits. No player will borrow any assets from the vault or other players at any time.

Mystery Cards:

If you land on the mystery card spaces you will draw one card and follow the directions for that card, all players must adhere to the mystery cards regardless of who draws the card.

Conspiracy File Series:

There are five series of conspiracy files for the American Conspiracy game. The first series comes with the game and additional series can be purchased separately. Different conspiracy file series can be mixed together to make the game more challenging and interesting.

Rapid Game:

The game starts out as normal but the first five conspiracy files each player lands on he/she acquires without payment to the CFO. The normal rule of having to make one revolution around the board before acquiring files is also not enforced. A time limit may be discussed at the beginning and the player who can answer three or more of the conspiracy challenge questions from their opponents will be the winner. If no players can answer three or more conspiracy challenge questions correctly the player with the most assets and Conspiracy files will declare victory by default when the time limit is up.

2. Description of the Prior Art

There are other board games designed for various educational purposes. While these board games may be suitable for the purposes for which they where designed, they would not be as suitable for the purposes of the present invention as heretofore described. It is thus desirable to provide a board game, which is designed to present American conspiracy knowledge to all persons involved in play. It is further desirable that this game utilizes American conspiracy information that is not easily attainable thereby making this particular board game both educational and entertaining.

SUMMARY OF THE PRESENT INVENTION

A primary object of the present invention is to provide an educational board game presenting information in one aspect of American history.

Another object of the present invention is to provide an educational board game which presents information focused on various conspiracies throughout American history.

Yet another object of the present invention is to provide an educational board game in which the presented American conspiracies are no longer at the forefront of American history.

Still yet another object of the present invention is to provide an educational board game which is designed to challenge all persons involved in play.

Yet another object of the present invention is to provide an educational board game which allows players to gain knowledge of the American conspiracies throughout American history as they engage in play.

Still yet another object of the present invention is to provide an educational board game which consists of American conspiracy information in an entertaining manner.

Additional objects of the present invention will appear as the description proceeds.

The present invention overcomes the shortcomings of the prior art by providing an educational board game that is comprised of authentic American government and newspaper article conspiracies involving the American people and culture.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
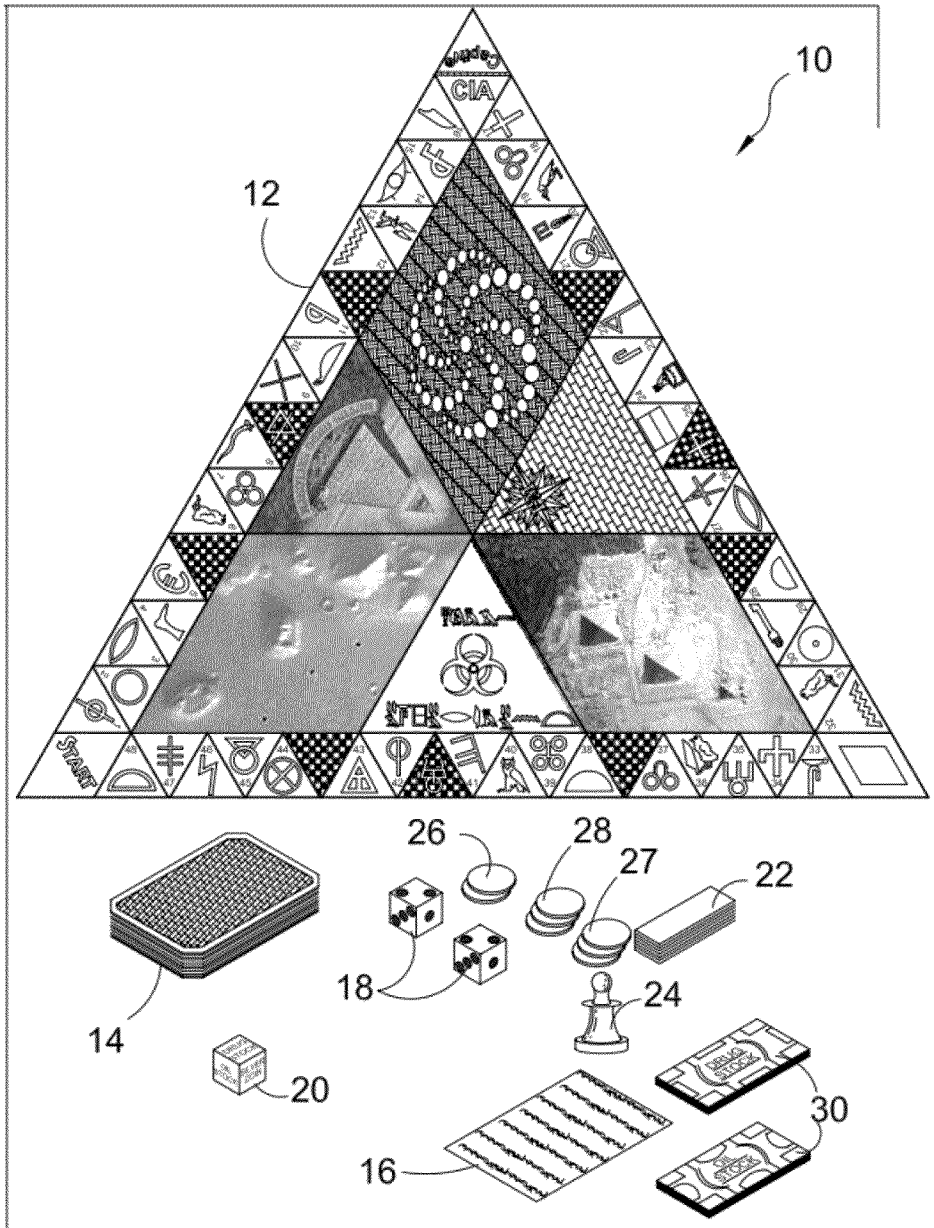
FIG. 1 is the top view of the game board showing all the sections as well as the game components required for play.

Turning now descriptively to the drawings, in which similar reference characters denote similar elements throughout the several views, the figures illustrate the American Conspiracy game of the present invention. With regard to the reference numerals used, the following numbering is used throughout the various drawing figures.

10 The American Conspiracy board game of the present invention
12 game board
14 mystery cards
16 conspiracy files
18 dice
20 money die
22 play money
24 player piece icon
26 platinum coin token
27 silver coin token
28 gold coin token
30 stocks
32 lower left segment of 12
34 lower right segment of 12
36 upper left segment of 12
38 upper right segment of 12
40 start space
42 saucer/UFO diamond
44 red brick triangle
46 game box

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

FIG. 1 is a top view of the conspiracy game 10 components. Shown is a top view of the present invention comprising a game board 12 having intricate symbols and illustrations representing different components of the conspiracies involved during play. Also shown are mystery cards 14, conspiracy files 16, dice 18, money die 20, play money 22, stocks 30, platinum coin tokens 26, gold coin tokens 28, silver coin tokens 27 and player piece icons 24.

Figure 2:
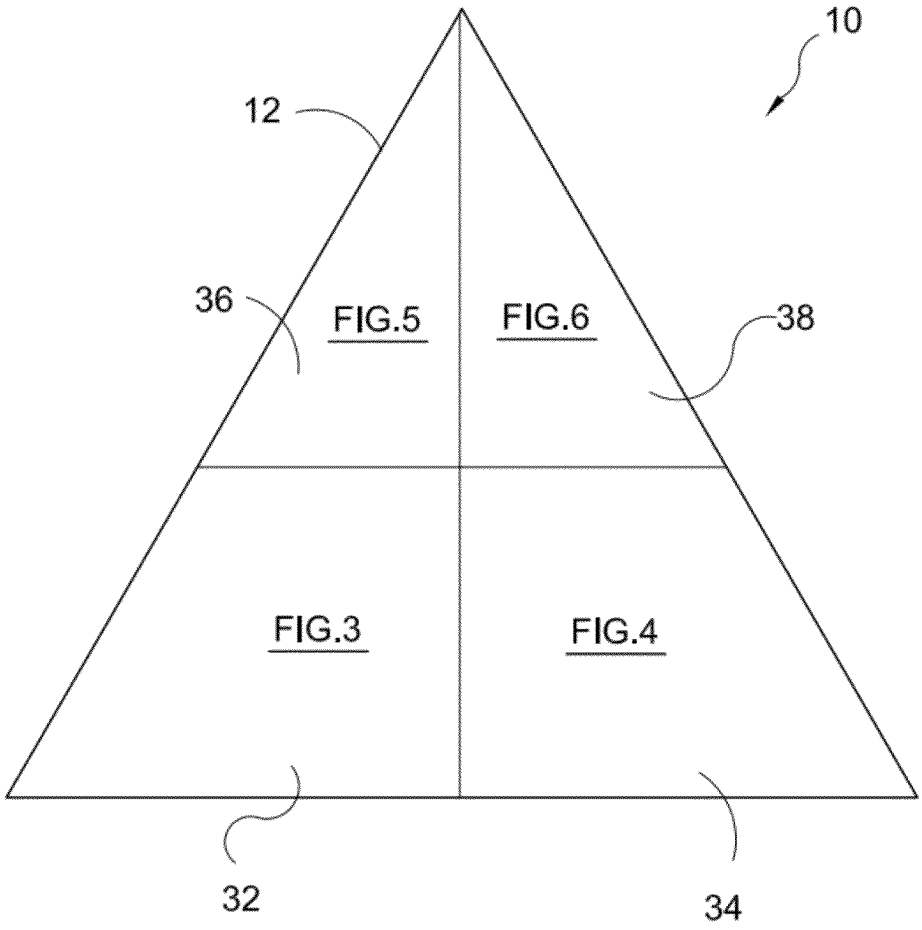
FIG. 2 is a top view of the game board which has been segmented into four sections to provide larger figure views in FIGS. 3, 4, 5 and 6.
Figure 3:
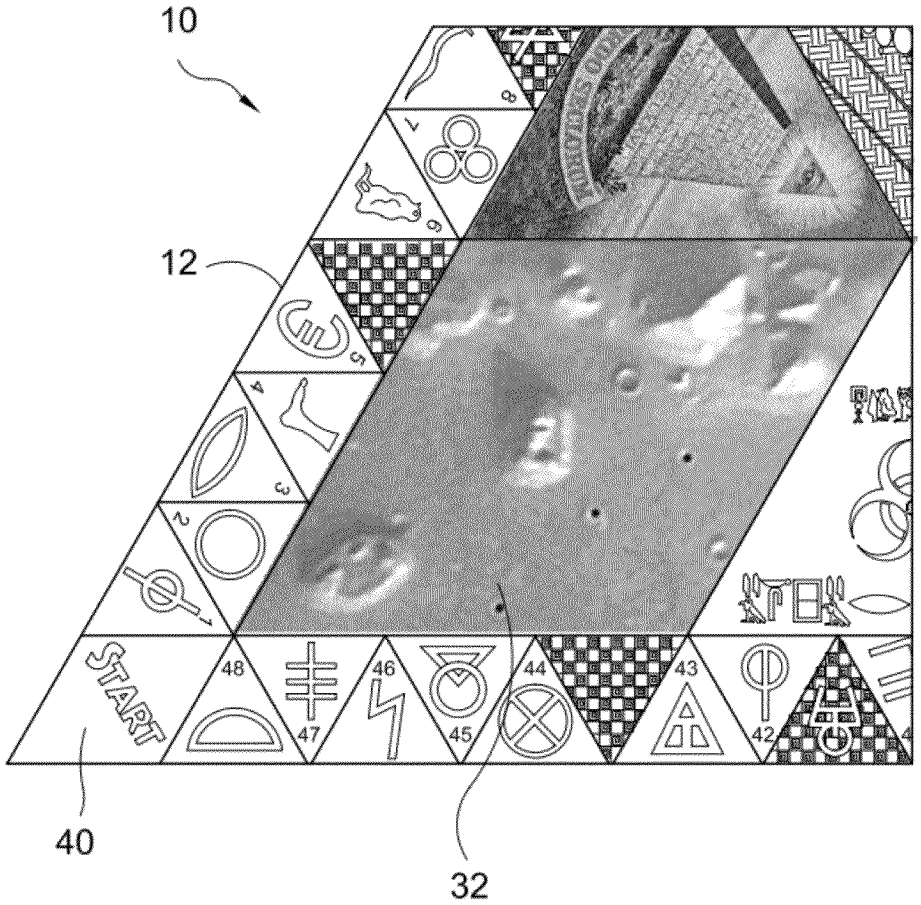
FIG. 3 is an enlarged top view of the lower left section of the game board.

FIG. 2 is a top view of the conspiracy game board 12 of the American Conspiracy game 10. Shown is a top view of the conspiracy game board 12 segmented into larger figure views which are shown in FIGS. 3, 4, 5 and 6; FIG. 3 being the lower left segment 32, FIG. 4 being the lower right segment 34, FIG. 5 being the upper left segment 36 and FIG. 6 being the upper right segment 38.

FIG. 3 is an enlarged view of a segment of the conspiracy game board 12 of the American Conspiracy game 10. Shown is a top view of the intricate symbols, drawings and game board trail which the players follow of the lower left segment 32 of the conspiracy game board taken from FIG. 2 as indicated. The diamond corner space marked START 40 represents the starting point of the board game. From this space players will move along the trail in a clockwise direction.

Figure 4:
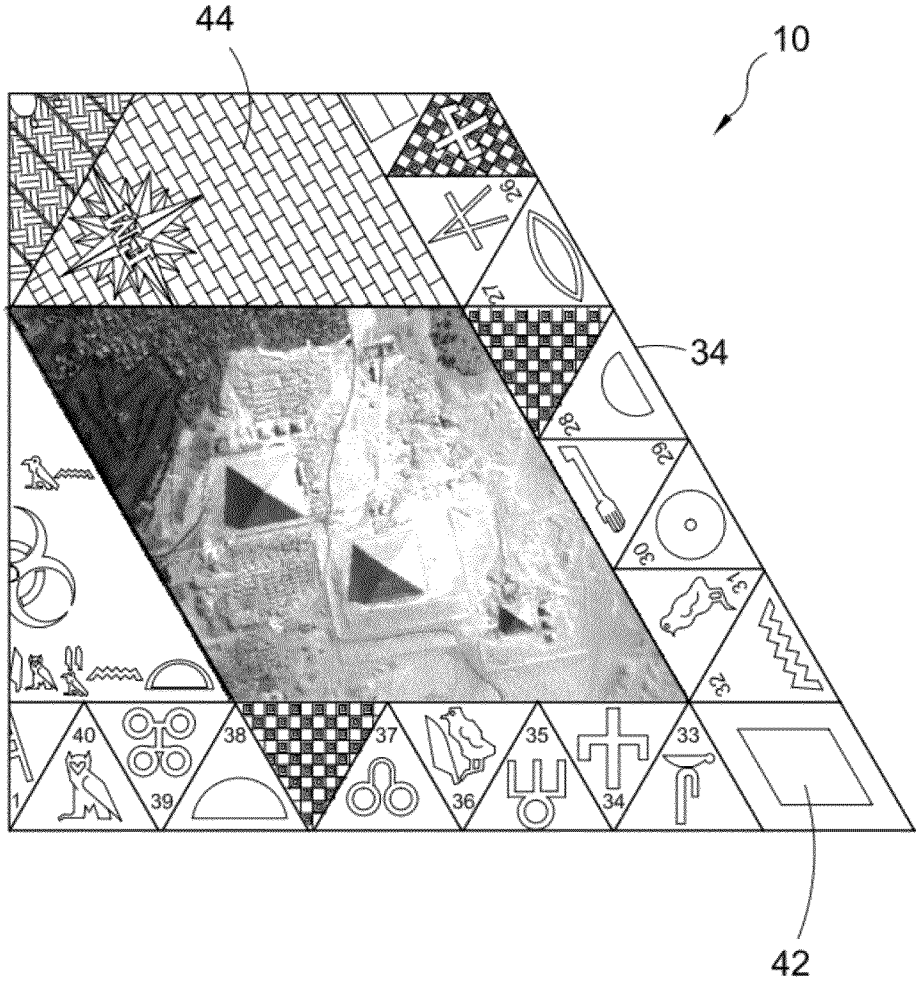
FIG. 4 is an enlarged top view of the lower right section of the game board.

FIG. 4 is an enlarged view of a segment of the conspiracy game board 12 of the American Conspiracy game 10. Shown is a top view of the intricate symbols, drawings and game board trail which the players follow of the lower right segment 34 of the conspiracy game board 12 taken from FIG. 2 as indicated. The diamond within the corner space represents the Saucer or UFO Diamond 42 which allows a player to collect the original money placed in the middle of the board and any other assets that have accumulated during the game if that player lands on this space. Also shown is the red brick triangle 44 in which the players place the mystery cards at the commencement of the game.

Figure 5:
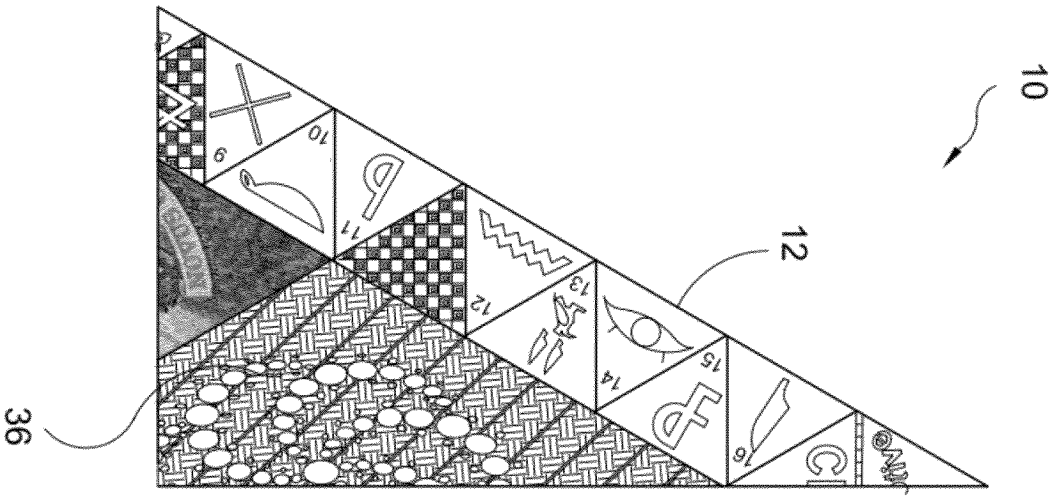
FIG. 5 is an enlarged top view of the upper left section of the game board.

FIG. 5 is an enlarged view of a segment of the conspiracy game board 12 of the American Conspiracy game 10. Shown is a top view of the intricate symbols, drawings and game board trail which the players follow of the upper left segment 36 of the conspiracy game board taken from FIG. 2 as indicated.

Figure 6:
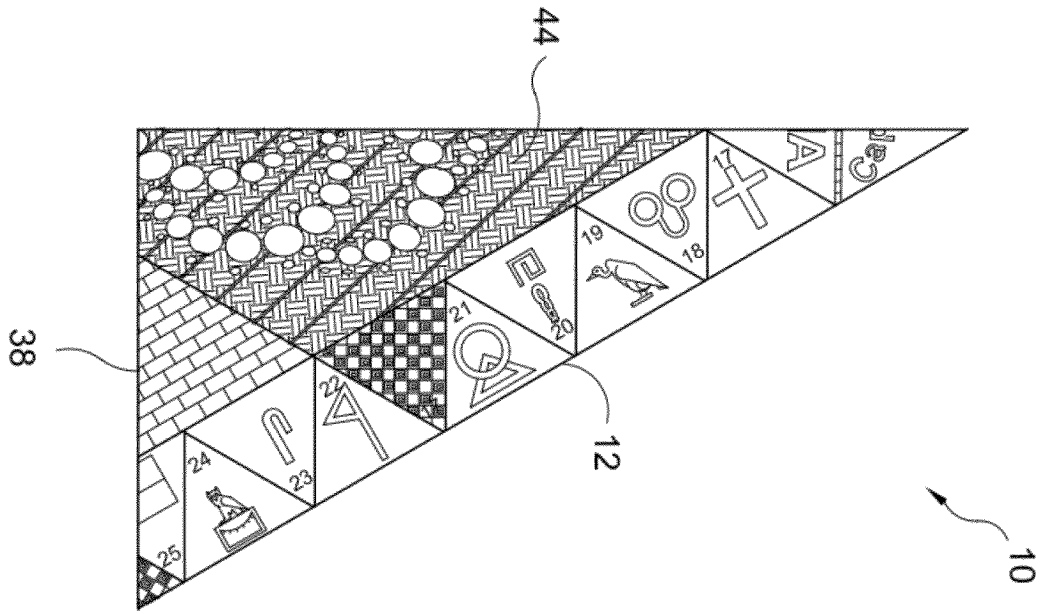
FIG. 6 is an enlarged top view of the upper right section of the game board.

FIG. 6 is an enlarged view of a segment of the conspiracy game board 12 of the American Conspiracy game 10. Shown is a top view of the intricate symbols, drawings and game board trail which the players follow of the upper right segment 38 of the conspiracy game board 12 taken from FIG. 2 as indicated. Also shown is a small portion of the red brick triangle 44 of FIG. 4.

Figure 7:
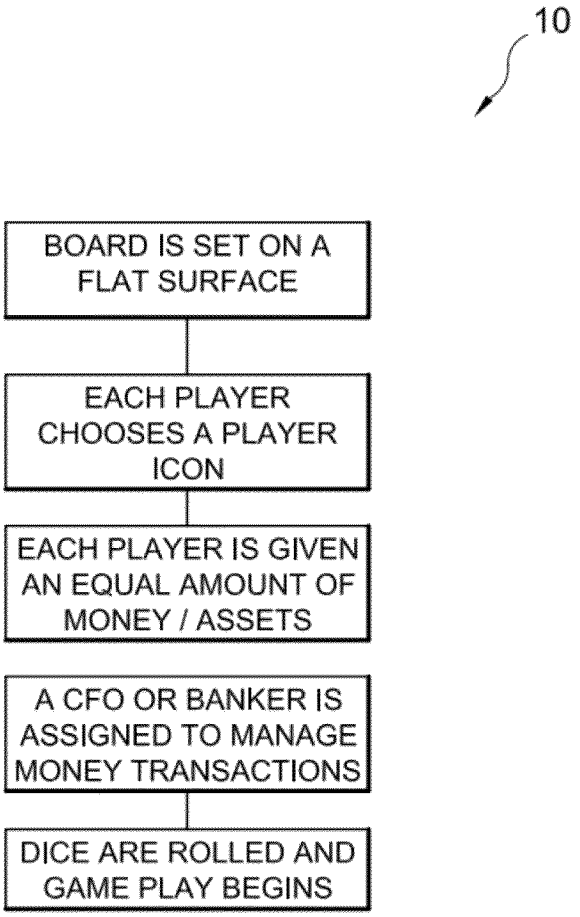
FIG. 7 is a block diagram outlining the start of game play.

FIG. 7 is a block diagram of game play for the conspiracy board game 10. Shown are the general rules of play before the game commences.

Figure 8:
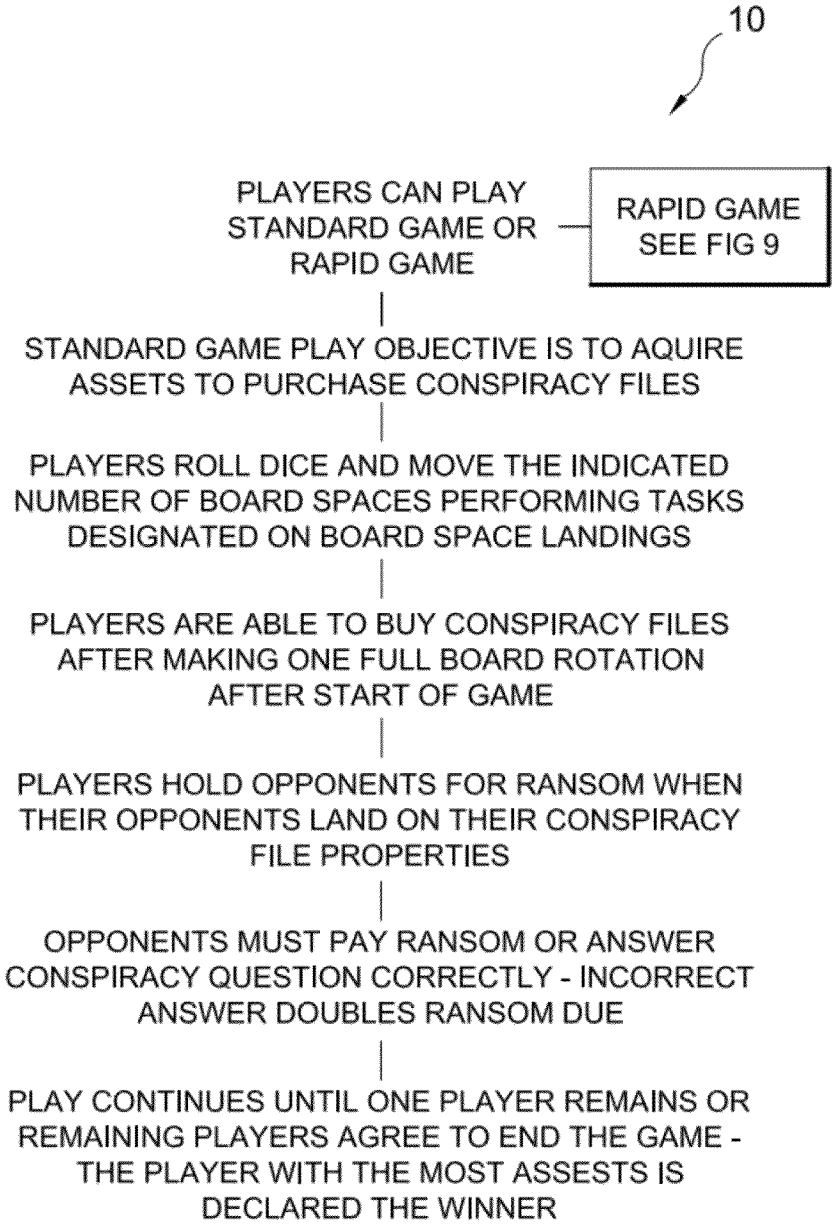
FIG. 8 is a diagrammatic overview for play during the standard version of play.

FIG. 8 is a diagrammatic overview of standard game play for the conspiracy board game 10. Shown is an overview of game play for the standard version of play.

Figure 9:
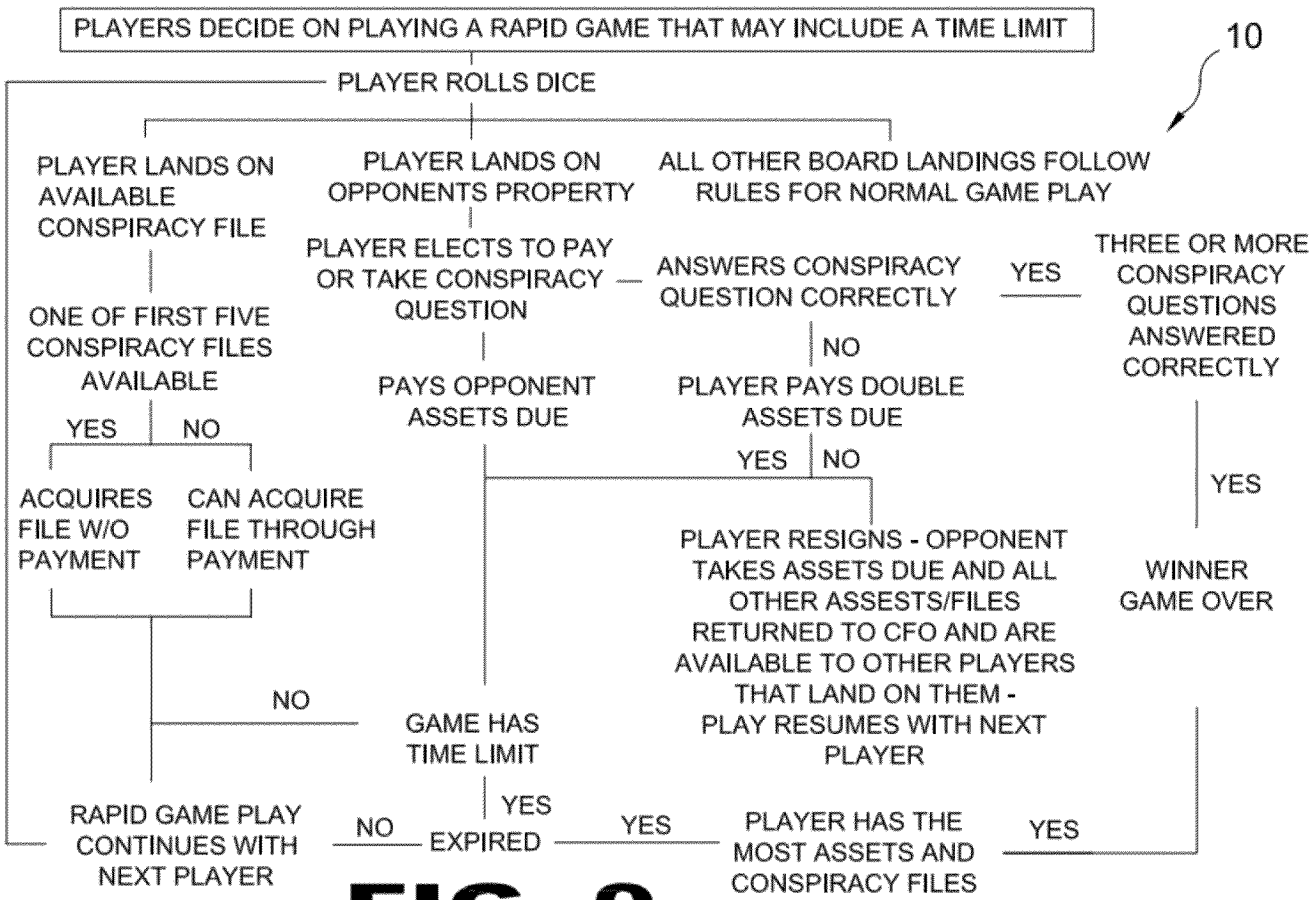
FIG. 9 is a diagrammatic overview for play during the rapid version of play.

FIG. 9 is a diagrammatic overview of rapid game play for the conspiracy board game 10. Shown is an overview of game play for the rapid version of play.

Figure 10:
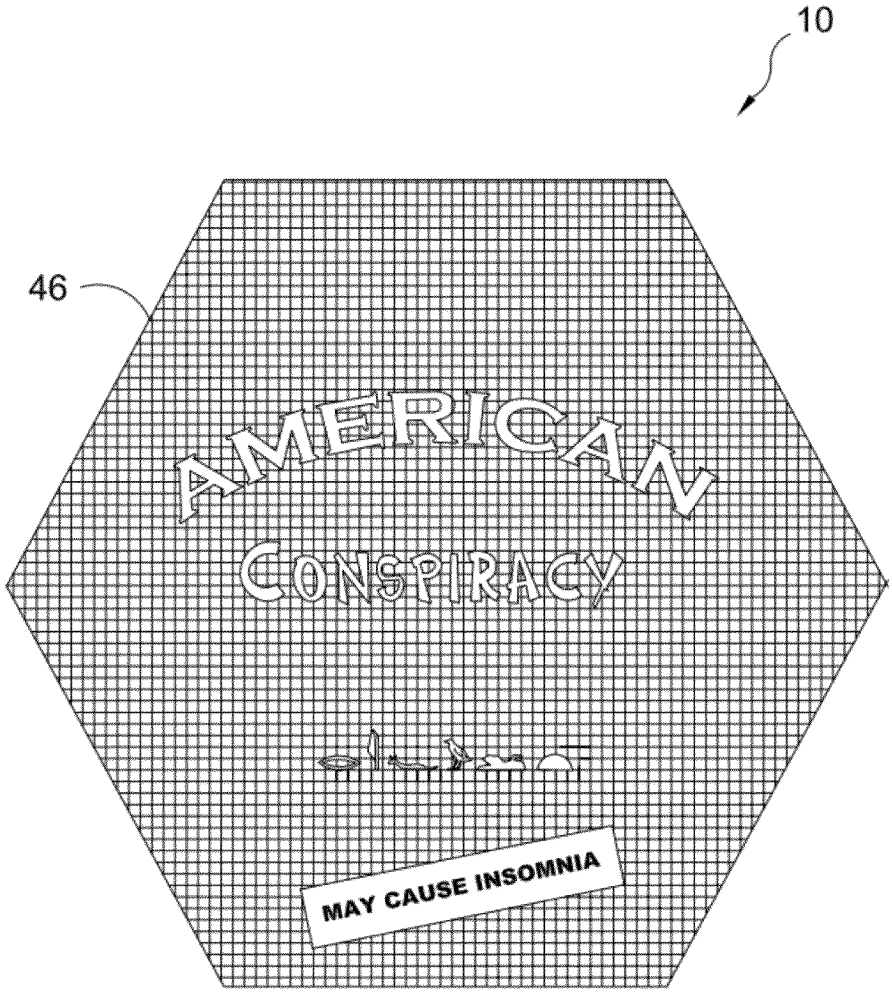
FIG. 10 is a top view of the game box of the present invention.

FIG. 10 is a top view of the game box 46 of the present invention 10. Shown is a top view of the game box 46 of the present invention 10.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. A board game for teaching about American Conspiracies, the board game comprising:

a) a game board having a plurality of game spaces bordering the periphery thereof forming a game board trail with each having varying symbols and drawings thereon and wherein the game board employs symbols selected from the group consisting of crop-circles, pyramids, hieroglyphics, and Eye of Providence and the symbols are used in conjunction with said conspiracy files;

b) a plurality of mystery cards;

c) a pair of dice;

d) means for assembling a collection of conspiracy files, each conspiracy file involving previously classified Freedom of Information Act documents pertaining to flying saucers, UFO's, and secret government experiments conducted on civilian and military personnel;

e) a money die;

f) a plurality of play money representing different denominations;

g) a plurality of player piece icons;

h) a plurality of coin tokens simulating gold, silver and platinum in a vault;

i) a first player occupying and owning a conspiracy file;

j) means for holding hostage a second player landing on the first player's conspiracy file; and k) means for allowing the hostaged second player to escape by other than paying a ransom.

2. The board game of claim 1, wherein each conspiracy file includes a plurality of questions related to the conspiracy in the conspiracy file, the hostaged second player being released by answering a question correctly about said conspiracy in said conspiracy file, the players thereby learning about the conspiracy in said conspiracy file.

3. The board game of claim 2, wherein said play money and coin tokens include gold coins, silver coins, and stock certificates.

* * * * *